US005626436A

United States Patent [19]

Dragone

[11] Patent Number: 5,626,436

[45] Date of Patent: May 6, 1997

[54] DOUBLE HOOK TO FASTEN CROSSED BARS

[76] Inventor: Mario Dragone, Via S. Antonio 18, 64100 Teramo, Italy

[21] Appl. No.: 379,438

[22] PCT Filed: Jun. 10, 1994

[86] PCT No.: PCT/IT94/00083

§ 371 Date: Feb. 8, 1995

§ 102(e) Date: Feb. 8, 1995

[87] PCT Pub. No.: WO94/29543

PCT Pub. Date: Dec. 22, 1994

[30] Foreign Application Priority Data

Jun. 14, 1993 [IT] Italy ..... TE93A0003

[51] Int. Cl.[6] ..... E04C 5/16

[52] U.S. Cl. ..... 403/400; 403/397; 403/398; 24/339; 24/556; 52/685; 52/686

[58] Field of Search ..... 403/397, 396, 403/398, 399, 400, 392, 395; 52/686, 685, 665; 24/339, 336, 545, 556, 557

[56] References Cited

U.S. PATENT DOCUMENTS

| | | | |
|---|---|---|---|
| 1,429,182 | 9/1922 | Ashley | 24/557 |
| 1,986,528 | 1/1935 | Ranger | 403/400 X |
| 2,407,249 | 9/1946 | Burner et al. | 52/686 |
| 2,961,479 | 11/1960 | Bertling | 403/400 X |
| 3,788,025 | 1/1974 | Holmes | 52/686 X |
| 4,110,951 | 9/1978 | Padrum | 52/686 |

FOREIGN PATENT DOCUMENTS

| | | | |
|---|---|---|---|
| 52210 | 10/1943 | France | 24/557 |
| 2247157 | 5/1975 | France . | |
| 823648 | 10/1951 | Germany . | |
| 848696 | 1/1952 | Germany . | |
| 1484969 | 3/1969 | Germany . | |
| 118789 | 2/1970 | Norway | 24/545 |
| 1040368 | 8/1966 | United Kingdom | 52/686 |

*Primary Examiner*—Anthony Knight
*Attorney, Agent, or Firm*—Watson Cole Stevens Davis, P.L.L.C.

[57] ABSTRACT

An elastic clip to fasten crossed bars, characterized in that it has the form of a simple or double couple of jaws symmetrically or asymmetrically shaped, which comprises seats (D) and hooks (A) placed crosswise and joined together by bodies (B) so that they can be managed simultaneously with fingers and are capable of fastening said either single or coupled crossed bars.

7 Claims, 1 Drawing Sheet

DOUBLE HOOK TO FASTEN CROSSED BARS

DESCRIPTION

The invention relates to a clip permitting to fix crossed bars, even coupled ones.

Such clip consists of two distinct and identical hooks of new shape for fastening a bar, that join together on the top in crossed direction to the hooks in order to form the jaws and the seats of the bar. Once the hooks are opened, exerting a pressure on the jaws, the clip can be placed on the crossing-point of the two bars and then when they are loose they close again pushing the bar on the crossed one which is blocked by the proper seats.

Such clip may be usefully employed in reinforced-concrete building as it permits quickly and safely a bond between the longitudinal iron bars and the stirrups. At present the binding of longitudinal bars to the reinforcement stirrups takes place by the use of iron wire and such, by welding and, not very often, by some kind of hooks. The welding process requires complex equipment which is difficult to use in building site, and the hooks are not very practical; both methods need skilled labour. The iron wire permits to bind, in order to cut down on costs and time, two or more concurrent bars to the detriment of the "air-gaps" required by rules. All this caused, especially in the past. Continuous disagreements between the building management and the executor contractors.

In this area there is another little-observed rule: the abutement stone. Such abutment stone and air-gap are required by the regulations in order to make the executed work correspond with the projected one and to ensure its endurance.

Many years ago, the technologic development put on the market a special distance piece for the abutment stone but it is not very used for its cost and for the long time of exposure, so still nowadays we rely on the will and skill of those employed on casting.

In order to make easier the work of the fitter of reinforced concrete bars and to fasten the stirrups to the longitudinal bar in a quickly and safetely way (this bond can be removed); in order to reduce the time of exposure and costs and in the meanwhile ensuring the compliance with the regulations about the abutment stone and air-gap, this study carried out by Ing. Dragone with the cooperation of his son Ing. Antonio Dragone, has lead to the realization of a practical clip called "double hook" provided with a new form of seats for bars in one direction and with hooks that can be elastically opened in the crossed direction and, as already said, when they close they fasten the crossed bars in observance of the law about the abutment stone and air-gap.

Figure 1:
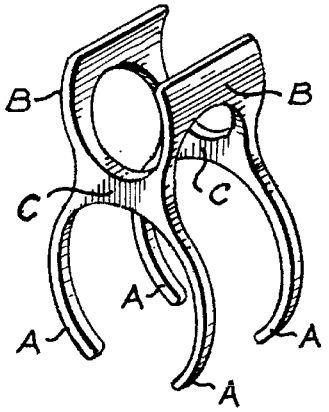

The double hook is formed shown in FIG. 1 of the attached drawing, of a double couple of opposing and integral semihook (A), in their median part (C), fulcrum of the double lever joined together by the bodies (B), orthogonal and oblique to the previous one forming the housings of the transverse bar and the opposing takings to control the double lever.

Figure 3:
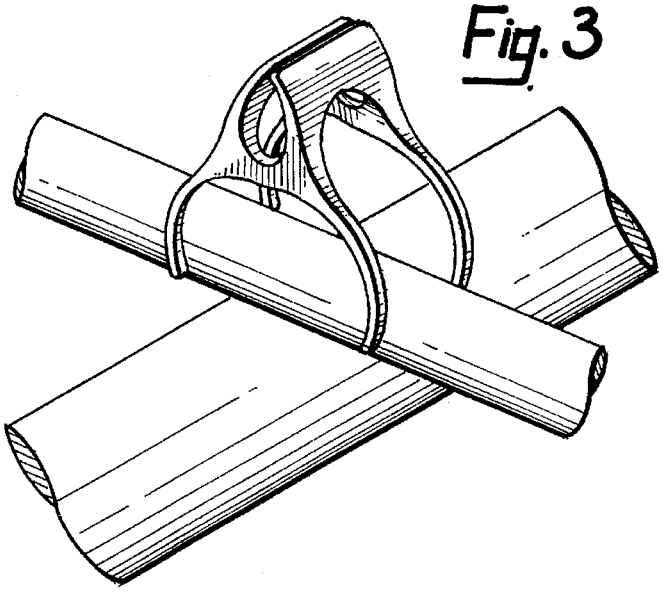

In fact, bringing the two bodies near, the semi-hooks separate from each other, in short: the double hook opens, FIG. 3, and it can be easily positioned being careful to include in the middle the transversal bar, the diameter of which has to exceed the distance between the two seats and those of the relative hooks.

Figure 2:
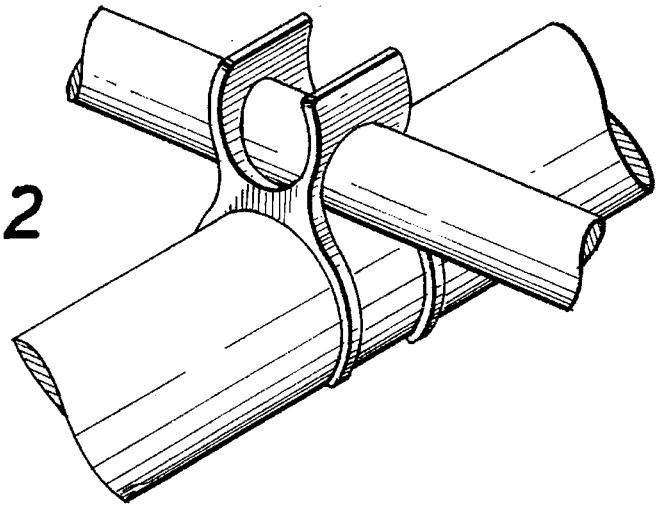

Loosening the bodies they separate from each other and consequently the semi-hooks draw near, in short: the double hook closes, FIG. 2, fixing together the two bars either for the shape or for the elastic distorsion of the initial forms. The bars have to be inferior to the geometrical ones that are necessary to the fastening of the two bars.

The above mentioned double hook can be realized with any kind of elastic compatible material with the bars to be fixed and with their relative use, as its shape, as in the attached drawing for round bars has to be considered indicative.

Particularly, the double hook for its simple positioning and removal, can be employed to fasten, before the casting, the longitudinal stirrups and irons, forming the reinforcement of the concrete.

This operation, at present, is carried out by the use of the iron wire; this because the hooks that are on sale are not practical. This new kind of hook will have success for its simple positioning and removal; you have only to exert a light pressure in order to open and place it, and also for the double symmetric form of the hook and of the elastic reactions as to the punctiform contact of the two bars where these latter form the stable fixing force, that can be ensured by a simple hook realized with only a half of this one. It has to be stated that a clip realized with only one hook and a lateral fixed seat, even if this latter is made with another hook, is theoretically able to fasten crossed bars but its stability is labile.

On the contrary, the link has to be resistant to the strokes and the vibrations of the casting, and this resistance can be ensured by the clip "double hook".

This clip, having the contact point of the bars inside a double system of symmetric bonds, presents several balance plans that ensures the resistance to the strokes and the vibrations of the casting.

The clip will be provided of a safety locking for the accidental strokes and unwanted reopening.

Furthermore, the double symmetric form makes its usage more quick and easier even for inexepert persons.

I claim:

1. A clip for holding together two transversely positioned bars, said clip defining a seat for positioning of one bar and a plurality of hooks for the positioning of the second bar, at least one of said hooks having an upper body defining a lever and said hooks are joined by structure defining a fulcrum.

2. The clip of claim 1 defining a plurality of seats and two hooks.

3. The clip of claim 2 defining two seats and two hooks.

4. The clip of claim 1 wherein the seat and hooks are positioned 90° to each other.

5. The clip of claim 1 wherein the seat is spaced from the hooks and forces contact laterally of the bars.

6. The clip of claim 1 wherein each of said hooks has an upper body.

7. A clip for holding together two transversely positioned bars comprising two bodies, each body having two curved legs to define two semihooks, said bodies being joined together at two points to define a fulcrum, each body between said curved legs defining an area to receive one bar, said semihooks of each body when said bodies are joined defining two hooks to hold the other of said bars.

* * * * *